US005810021A

United States Patent [19]

Walker

[11] Patent Number: 5,810,021

[45] Date of Patent: Sep. 22, 1998

[54] NAIL POLISH REMOVER DEVICE

[76] Inventor: Alvin M. Walker, 143 Lake Shore Dr., North, Palm Harbor, Fla. 34684

[21] Appl. No.: 650,757

[22] Filed: May 20, 1996

[51] Int. Cl.[6] ..... A45D 29/18

[52] U.S. Cl. ..... 132/74.5; 132/76.4

[58] Field of Search ..... 132/73.6, 74.5, 132/75.8, 76.4, 73; 15/104.04, 167.1, 167.3

[56] References Cited

U.S. PATENT DOCUMENTS

| | | | |
|---|---|---|---|
| 1,374,851 | 4/1921 | Hirth | 132/73 |
| 2,580,981 | 1/1952 | Webster | 132/73 |
| 2,629,124 | 2/1953 | Merritt | 132/73 |
| 3,188,674 | 6/1965 | Hobbs | 15/104.04 |
| 3,316,922 | 5/1967 | Seidler | 132/75 |
| 3,966,335 | 6/1976 | Abramson | 401/10 |
| 4,172,682 | 10/1979 | Salukvadze | 15/104.4 |
| 4,255,826 | 3/1981 | Boyd | 132/74.5 |
| 4,282,891 | 8/1981 | Duceppe | 132/73.5 |
| 4,321,936 | 3/1982 | Chaconas | 132/73.5 |
| 4,397,324 | 8/1983 | Thomas, Jr. | 132/73.5 |
| 4,439,884 | 4/1984 | Giorni | 15/104.04 |
| 4,440,181 | 4/1984 | Scherer | 132/73.5 |
| 4,474,195 | 10/1984 | Warner | 132/73 |
| 4,480,351 | 11/1984 | Koffler | 15/187 |
| 4,819,672 | 4/1989 | Walker et al. | 132/73.5 |
| 4,866,806 | 9/1989 | Bedford | 15/104.94 |
| 5,048,547 | 9/1991 | Walker | 132/75 |
| 5,379,474 | 1/1995 | Nakamura | 132/73.6 |
| 5,454,131 | 10/1995 | MacKenzie | 15/104.92 |
| 5,566,416 | 10/1996 | Karls | 15/104.04 |

FOREIGN PATENT DOCUMENTS

| | | | |
|---|---|---|---|
| 682639 | 11/1952 | United Kingdom | 132/74.5 |
| 1031561 | 6/1966 | United Kingdom | 15/104.04 |

*Primary Examiner*—Todd E. Manahan
*Attorney, Agent, or Firm*—Gipple & Hale; John S. Hale

[57] ABSTRACT

A nail polish remover device adapted for removing fingernail polishes comprises a cylindrical receptacle defining a chamber, an interior annular channel on the cylinder wall and a peripheral channel on the receptacle base. The receptacle also has a central post portion and is provided with a removable, flexible liner disposed within the chamber and having bristles extending toward the central post portion and an annular rib around the exterior which mates with the interior annular channel on the cylinder wall. When the removable liner is in place in the chamber the exterior rib is positioned in the annular channel of the container and the distal end of the liner is in contact with the bottom of the peripheral channel of the container.

13 Claims, 2 Drawing Sheets

NAIL POLISH REMOVER DEVICE

BACKGROUND OF THE INVENTION

1. Field of Invention

The present invention relates to devices for removing fingernail polish and in particular relates to an integrally molded device having a bristle liner suitable for removing fingernail polish.

2. Description of the Prior Art

The prior art contains many patents directed to nail polish removal receptacles which support or suspend an insert structure to aid in the removal of hardened nail polish from fingernails after a finger has been immersed in nail polish remover contained within the receptacle. U.S. Pat. Nos. 4,474,195; 4,440,181; 4,282,891 disclose nail polish remover devices in which a receptacle is provided with a sponge or sponge-like absorbent member insert. The sponge member insert is provided with an aperture forming a finger hole into which the finger is placed. The absorbent sponge absorbs nail polish remover and upon insertion of the finger into the sponge aperture, the polished fingernail comes into contact with the sponge and nail polish remover solution to remove the polish from the nail. The solution and polish fragments are wiped from the inserted fingernail by the sponge as the fingernail is removed from the receptacle jar. A multi-layered foam surgical scrub sponge similar to those noted above is shown by U.S. Pat. No. 4,866,806. In this reference a removable serrated insert is accommodated in the center of the sponge to enable insertion of the fingers to cleanse and disinfect the cuticle areas.

U.S. Pat. No. 4,480,351 discloses a surgical scrub brush provided with two sets of brushes in each side of the molded body. The brush bristles are formed with a configuration of smaller bristles disposed in a longitudinal channel or gap between taller bristle groups whose tips are laterally exposed to facilitate nail cleaning. The individual bristle members have a triangular cross-section.

Another surgical scrub brush is shown in U.S. Pat. No. 3,966,335. This patent features four bristle-lined troughs for simultaneous scrubbing of the four fingers. Rows of relatively short stiff bristles are used for cleaning the finger tips, nails and under the nails.

U.S. Pat. No. 4,397,324 discloses a nail polish receptacle which is provided with a brush member disposed in the receptacle by wire legs which support the brush element in the approximate determines of a circular finger opening. Similarly, U.S. Pat. No. 4,321,936 discloses a nail polish remover receptacle containing a plurality of downwardly spaced apart free floating legs with an inwardly curved end portion. The legs have bristles or brush like elements secured thereto which extend inward. When a person inserts a finger into the device, the finger will contact the bristles and push the legs outward in such a manner that the nail polish remover liquid on the bristles will remove the nail polish from the fingernails. U.S. Pat. No. 3,316,922 discloses a nail polish remover device in which a circular brush with a circular open center is mounted on a group of abutments extending inwardly from an insert surface. The brush member is positioned on the abutments and the brush stem is moved against the abutments to snap into an inclined position.

U.S. Pat. No. 4,397,324 discloses a combination golf ball and club head cleaner that is mounted to the fender of a golf cart or post. The device includes a watertight housing having a first brush-lined chamber for cleaning a golf ball and a second brush-lined parallelepiped chamber for cleaning a golf club. A ball holder that retains a ball while allowing it to rotate when scrubbed is mounted for reciprocation along its vertical axis in the ball cleaning chamber. Brushes lining the first chamber scrub the ball as the holder is reciprocated.

An apparatus for cleaning and sanitizing combs through mechanical bristles and disinfectant fluids is disclosed in U.S. Pat. No. 5,454,131. The apparatus includes a container having a rectangular base with enlarged rectangular front and rear walls and smaller rectangular side walls. The container further includes a lid having a lower open end which is removably positioned on the upper edges of the walls. A plurality of pointed semi-rigid bristles are secured to the interior surfaces of the front and rear walls of the container.

U.S. Pat. Nos. 5,048,547 and 4,819,672 issued to the present inventor disclose a cylindrical housing holding a one piece brush assembly which has inwardly projecting integral triangular shaped bristles configured to receive a finger and remove the fingernail polish.

It can thus be seen that the aforenoted patents do not teach or show the present invention which utilizes an integrally molded device having a removable bristle liner which provides a simple means of removing nail polish from the fingernails in a clean environment relatively free of bacteria and virus. Many of the above cited patents use sponge or sponge-like product to apply nail polish remover to the fingernails. There are reservations about the use of sponge product in beauty salons because of the occurrence of bacterial collection and growth in the sponge.

SUMMARY OF THE INVENTION

The present invention provides for a unique injection molded receptacle which provides for better fingernail cleaning and conditioning through the use of a central post with a removable molded brush bristle liner surrounding the post. The device is made of three separate injection molded pieces: the container itself, the liner which has the integrally molded bristles and a cap. The separate, molded, removable cylindrical liner snaps into place in a groove formed in the inner wall of the cylindrical container and holds the bristle liner in place. The removable cylindrical liner substantially covers the interior side wall of the container and positions the bristles so that they are directed toward the center of the container.

Thus the bristles are positioned in a fixed relationship to provide maximum contact with the fingernails when the fingers are inserted into the interior of the polish remover container. Each bristle member is spaced in bristle rows which are separated to allow a constant flow of nail polish remover or conditioner into the brushing area during the brushing period and continuous circulation of the liquid throughout the container. The container can be easily cleaned or sterilized to remove any bacterial or viral growths as well as any cuticle material that has been torn or pulled off by the brush by removing the cylindrical liner and replacing it with a new one. Proper sterilization and hygiene are of the utmost importance to the cosmetology industry and to the individual retail consumer. Cleanliness is of particular importance if the soft tissue surrounding the fingernail, especially the cuticle area, is open and bleeding. This frequently occurs due to job related tearing of the cuticles or from habitual fingernail biting. Such open wound areas are frequently sources for the transmission of dangerous pathogens such as bacteria, fungi, and viruses. It is possible that this could be a pathway for the transmission of acquired immune deficiency syndrome (AIDS) if several people use the same container. In any event there is a common perception among consumers that a multiply used container presents such a problem.

Another important objective of the present inventive nail polish remover device is to provide the user with a means for removing nail polish from multiple fingers simultaneously. To accomplish this, the opening in the top of the nail polish remover container is made large enough to accommodate more than one digit of the user's hand and possibly all five digits at once depending on the user's hand size. The bottom of the container incorporates a centered novel tapered post which rises in an upward direction into the interior of the chamber of the receptacle. This tapered post serves several purposes; namely reducing the volume of the interior of the container so that an excessive amount of nail polish remover will not be required to raise the fluid level of the device; and it provides automatic rotation of the fingers against the bristles and a finger support.

These and other objects, advantages and novel features of the present invention will become apparent when considered with the teachings contained in the detailed disclosure along with the accompanying drawings.

DETAILED DESCRIPTION OF PREFERRED EMBODIMENT

Figure 1:
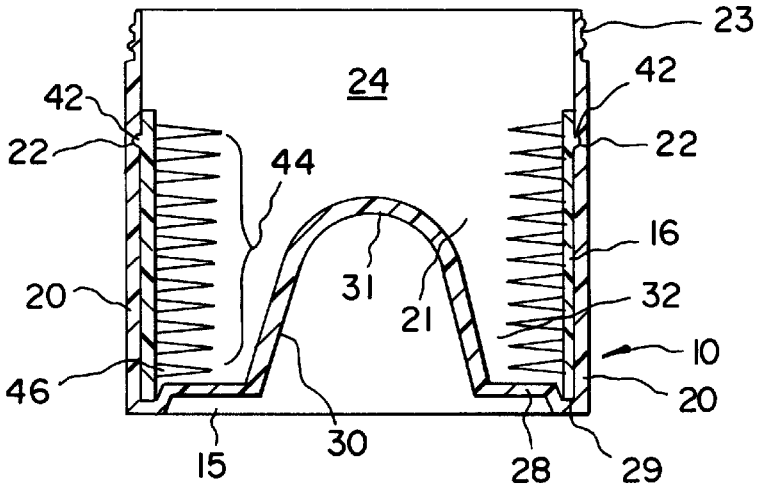
FIG. 1 is an enlarged cross-sectional view of the nail polish remover device with cap removed showing the cylindrical liner and integral bristles lining the interior.

The preferred embodiment and the best mode of the present invention is shown in FIGS. 1 through 7. As shown in the Figures, the inventive nail polish remover device is generally designated by the numeral 10 and comprises three basic pieces or parts: a cylindrical container 15, a bristle liner 16 having integrally molded bristle members and a threaded cap 18. The container 15 has a cylindrical wall 20 which forms a circular opening at the top or proximal end of the container 15 thereby providing a means for the fingers to enter the container chamber 24. The exterior outer surface of the cylindrical wall 20 is formed with threads 23 which engage and hold cap 18. The interior wall surface 21 of the cylindrical wall 20 is provided with an annular bristle liner receptor groove 22. The base 28 of the container 15 is stepped to provide a peripheral container channel 29 which extends continuously around the outer periphery of and below the surface of the container bottom 28 and the end of bristle liner 16. The central portion of the container bottom 28 has an inclined post member 30 with a rounded top surface 31 which extends into the container chamber 24. The post member 30, the container bottom 28, and the cylindrical wall 20 cooperate to define an annular finger area or channel 32.

Figure 2:
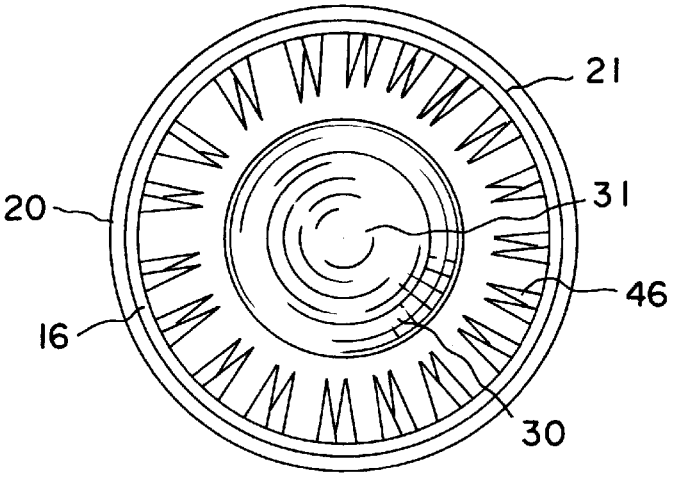
FIG. 2 is a top plan view of nail polish remover device shown in FIG. 1.
Figure 3:
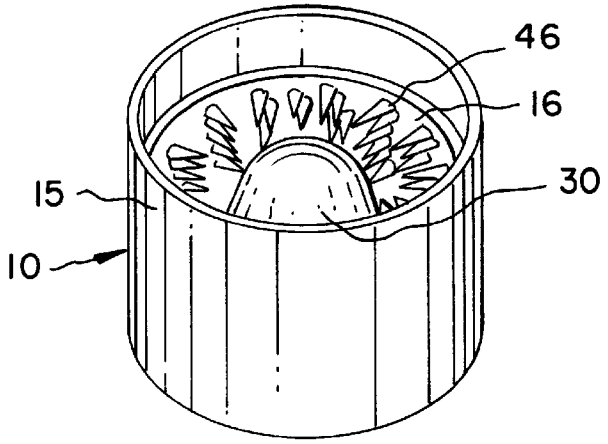
FIG. 3 is a perspective view of the nail polish remover device of FIG. 1.
Figure 4:
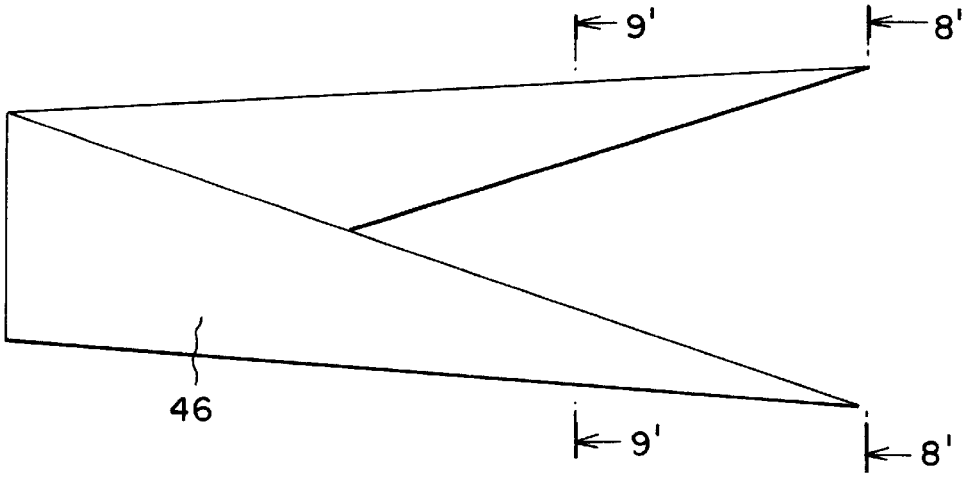
FIG. 4 is a top plan view of one pair of blade shaped bristles.

A flexible bristle liner 16, which is a separately molded piece, is of an appropriate size and shape to line the interior wall surface 21. The bristle liner 16 has a flexible cylindrical base member 40 formed with an external linear bead or rib 42 formed on one side which is dimensioned to form a snap fit in cylinder wall groove 22 and a number of spaced bristle rows 44 formed on the other side. The bristle rows 44 are constructed of spaced rows of bristle pairs 46 extending angularly from the inner surface of the bristle liner 16 when the same is mounted on the interior wall surface as shown in FIG. 2. The plurality of spaced rows of bristles 44 extend generally toward the center of the container chamber 24 and toward the post member 30. Pairs of bristles 46 are equally spaced along each row and are of equal length as seen in FIG. 4. The two bristles of each bristle pair 46 are angularly inclined away from each other and form a V-shaped spacing therebetween as shown in FIG. 4. Each bristle forms an angle which will intersect with the adjacent bristle of the adjacent bristle pair as shown in FIG. 2. The bristle pair rows 44 are equally spaced around the inner surface of the liner base 40. The number of bristle pair rows can range from 24 to 40 with the preferred number of rows being 32. The spaces between the pairs of bristles 46 and between the rows of bristles 44 allow the nail polish remover solvent placed within the container 15 to flow freely into the brush area. The brush surface thus has a full 360° radius and has no metal parts or sponge-like foam.

The cylindrical bristle carrier liner 16 is made of a flexible and resilient plastic material that can be deformed when a balanced force is applied but returns immediately to its original shape after the force is removed so that the annular rib 42 on the cylindrical bristle liner base 40 can be snap fit or snugly fit into the annular container groove 22 to hold the cylindrical bristle liner 16 firmly into place within the container chamber 24. When cylindrical bristle liner 16 is snapped into place within the container chamber the distal end of the cylindrical bristle liner extends below the level of the container bottom 28 to contact the bottom surface of the peripheral container channel 29. In the preferred embodiment the container 15 is made of a relatively hard, inflexible plastic and the inner liner 16 and bristles 46 are made of a relatively soft flexible plastic material.

Variations of the above preferred embodiment are contemplated by the inventor. The cap 18 in the illustrated best mode and preferred embodiment is secured to the container 15 by means of screw threads as described above but other means of attaching the cap which are well-known in the art can be used.

Figure 5:
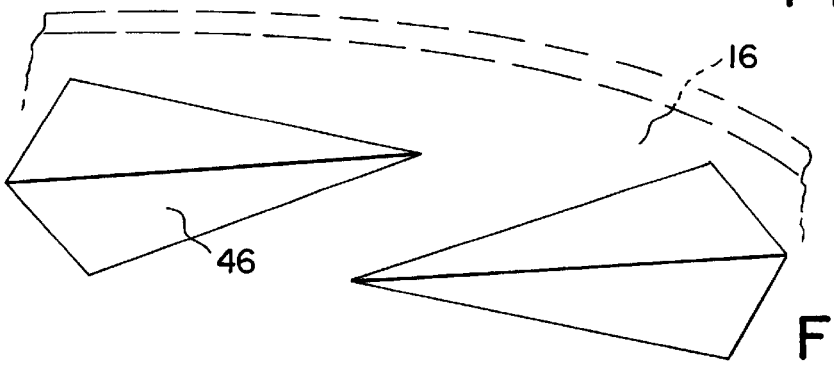
FIG. 5 is an end view of the pair of blade shaped bristles taken along the line 8'—8' of FIG. 1.
Figure 6:
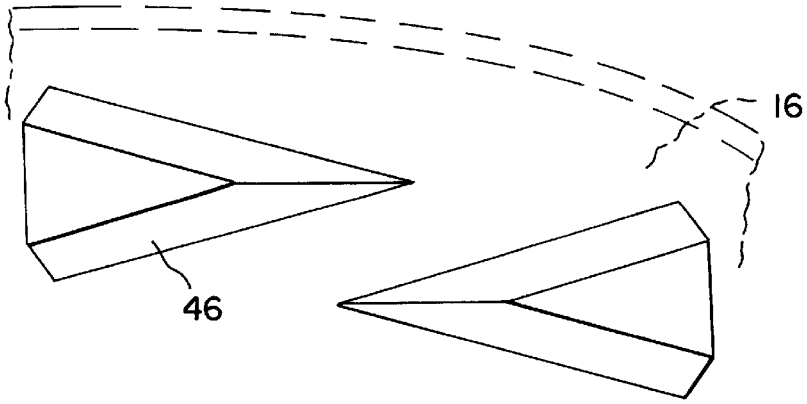
FIG. 6 is a cross-sectional view of the pair of blade shaped bristles taken along the line 9'—9' of FIG. 4.
Figure 7:
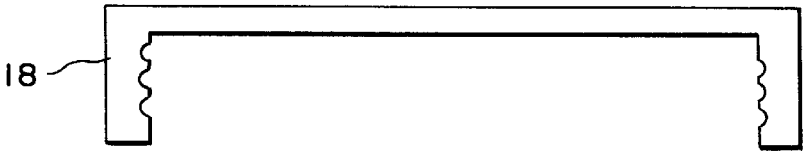
FIG. 7 is a cross-sectional view of the cap.

In addition, other shapes for the nail polish remover receptacle are contemplated by the inventor including ellipsoidal or oval. Bristles of different lengths, diameters, degrees of stiffness, and of various shapes and numbers may be used. For example, the tips of the bristles 46 can be conical or pointed, rounded, flat or chisel shaped. The bristles shown in FIGS. 1 and 2 are blade shaped as shown in detail in FIGS. 4 and 5. Each blade has a generally triangular base and three flat surfaces. Enlarged plan and end views of one pair of bristles are shown in FIGS. 4 and 5. The bristles 46 of the illustrated preferred embodiment are integrally formed with the liner 16 by molding them as one piece. Individual natural or synthetic bristles or groups of bristles may, however, be secured to the liner 16 by any means known to one skilled in the art.

The device is designed so that it can be easily and economically fabricated by injection molding and the bristles 46 can be integrally molded with the liner 16. The entire construction of the container 15, liner 16 and cap 18 is preferably made from a flexible and resilient material such as polyethylene or polypropylene. The flexible and resilient plastic material is chosen so that the removable liner can be readily snapped into place or removed to provide for easy assembly of the device and replacement of the liner 16. The composition of the nail polish remover device 10 is such that it is virtually impervious to the deleterious effects of nail polish solvent in both its liquid and vapor phases. In other embodiments the cylindrical bristle liner 16 can be made without the bead 42 and held in place by sonic welding or other techniques known to one skilled in the art. The solvent solution can be emptied from the container 15 and container washed out as desired and reused in any manner desired to provide optimum cleanliness and hygiene.

In operation the container is filled with polish remover. The user inserts a plurality of fingers into the container chamber 24. The fingernail tips can then enter annular finger channel 32 where the fingernails come in contact with nail polish remover solvent and the tips of the bristles 46. The fingernails are moved across the bristles 46 to score the painted surface, further aiding in the removal of the polish. The fingers are supported and orientated by the center post 30 as the fingertips are moved across the bristle tips. Upon the removal of the fingers from the nail polish remover device the bristles 46 revert to their original memory positions.

What is claimed is:

1. A nail polish remover device comprising:

a container defining a top opening and a container chamber with a stationary central post member extending into said chamber; said central post member being provided with a rounded top;

a removable liner comprising a cylindrically shaped base member mounted in said container chamber surrounding said post member, a plurality of bristle members secured to an interior wall side of said cylindrically shaped base member and liner holding means secured to an opposite exterior wall side of cylindrically shaped base member; said liner holding means comprising an integrally formed bead means which mates with a groove formed in an interior surface of said container;

said bristle members extending into the interior of said container chamber when said removable liner is mounted into said container chamber, with said removable liner holding means maintaining said removable liner in a fixed position within said container.

2. A nail polish remover device comprising:

a container comprising a base assembly and at least one wall means surrounding said base assembly, said base assembly and said at least one wall means cooperating to define a top opening, a container chamber and a bottom of said container;

said base assembly comprising a platform area and an inclined central post extending away from said platform area; an annular channel defined in said platform area between said central port and an outer peripheral edge of said container chamber to seat a removable liner member;

said removable liner member being removably mounted to an interior surface of said at least one wall means to surround at least a portion of said inclined central post, said liner member being dimensioned to cover a majority of the interior surface of said at least one wall means of said container;

said removable liner member further including bristle means formed thereon and extending therefrom into the container chamber toward said central post when said removable liner member is mounted in said container;

liner holding means mounted on said liner member for maintaining said liner member in a fixed but removable position within said container chamber.

3. A nail polish remover device as claimed in claim 2 wherein said container is cylindrical.

4. A nail polish remover device as claimed in claim 2 wherein said container is polypropylene.

5. A nail polish remover device as claimed in claim 2 wherein said container is polyethylene.

6. A nail polish remover device as claimed in claim 2 wherein said liner holding means comprises a continuous annular groove defined in an interior wall surface of said at least one wall means and a continuous annular rib formed on an exterior surface of said liner, said annular groove and said annular rib being positioned to mate together when a distal end of said liner member is seated is in the annular channel defined in said platform area.

7. A nail polish remover device as claimed in claim 2 wherein said bristle means comprises a plurality of bristle members equally spaced in rows ranging from 24 to 32 in number and said rows of bristle members extend 360° around the interior of said cylindrical container.

8. A nail polish remover device as claimed in claim 2 further comprising a cap holding means.

9. A nail polish remover device as claimed in claim 2 wherein said bristle means are a plurality of bristle members equally spaced in about 32 equally spaced parallel rows.

10. A nail polish remover device comprising:

a cylindrical container with a base and wall means extending from said base defining a top opening and a container chamber, a central tapered post member is integrally formed with said base and extends from said base into said container chamber, said central post member being axially aligned with the central longitudinal axis of said cylindrical container, said base being stepped to provide a peripheral liner channel which extends around said base adjacent said wall means to seat a removable liner;

a removable liner comprising a substantially cylindrical base member, a plurality of bristle members integrally formed with said base member and extending away from one side of said base member and liner holding means secured on the opposite side of said liner base member;

said bristle members extending into the interior of said container chamber when said liner is mounted into said container chamber against said wall means, with said liner holding means maintaining said removable liner in a fixed position within said container.

11. A nail polish remover device as claimed in claim 10 wherein said bristle members are a plurality of bristles spaced in rows which are separated to allow a constant flow of liquid during brushing.

12. A nail polish remover device as claimed in claim 10 wherein said bristle members are a plurality of bristles equally spaced in rows ranging from 24 to 32 in number and said rows of bristle members extend 360° around the interior wall means of said cylindrical container.

13. A nail polish remover device comprising:

a container comprising a base assembly and at least one wall means surrounding said base assembly, said base assembly and said at least one wall means cooperating to define a top opening, a container chamber and a bottom of said container;

said base assembly comprising a platform area and an inclined central post extending away from said platform area, said central post and platform area forming a bell-shaped configuration when viewed in section and wherein a peripheral portion of said platform is stepped to provide a continuous liner channel which extends around the outer periphery of said container chamber;

said removable liner member being removably mounted to an interior surface of said at least one wall means to surround at least a portion of said inclined central post, said liner member being dimensioned to cover a majority of the interior surface of said at least one wall means of said container;

said removable liner member further including bristle means formed thereon and extending therefrom into the container chamber toward said central post when said removable liner member is mounted in said container;

liner holding means mounted on said liner member for maintaining said liner member in a fixed but removable position within said container chamber.

* * * * *